US010609783B2

(12) United States Patent
Horst et al.

(10) Patent No.: US 10,609,783 B2
(45) Date of Patent: Mar. 31, 2020

(54) SELF-MONITORING MARINE NAVIGATION LIGHT

(71) Applicants: David J Horst, Baltimore, MD (US); Jerry A. Carr, Reisterstown, MD (US)

(72) Inventors: David J Horst, Baltimore, MD (US); Jerry A. Carr, Reisterstown, MD (US)

( * ) Notice: Subject to any disclaimer, the term of this patent is extended or adjusted under 35 U.S.C. 154(b) by 0 days.

(21) Appl. No.: 16/195,367

(22) Filed: Nov. 19, 2018

(65) Prior Publication Data

US 2019/0159306 A1 May 23, 2019

Related U.S. Application Data

(60) Provisional application No. 62/707,815, filed on Nov. 20, 2017.

(51) Int. Cl.

| | |
|---|---|
| ***H05B 33/08*** | (2020.01) |
| ***F21V 23/00*** | (2015.01) |
| ***F21V 5/04*** | (2006.01) |
| ***B63B 45/02*** | (2006.01) |
| ***F21V 23/04*** | (2006.01) |
| ***H05B 37/03*** | (2006.01) |
| *F21Y 115/10* | (2016.01) |

(52) U.S. Cl.

CPC ..... *H05B 33/089* (2013.01); *B63B 45/02* (2013.01); *F21V 5/04* (2013.01); *F21V 23/006* (2013.01); *F21V 23/0457* (2013.01); *H05B 37/03* (2013.01); *F21Y 2115/10* (2016.08)

(58) Field of Classification Search

CPC ..... H05B 33/089; B63B 45/02; F21V 5/04; F21V 23/006; F21V 23/0457

See application file for complete search history.

(56) References Cited

U.S. PATENT DOCUMENTS

| | | | | |
|---|---|---|---|---|
| 5,890,794 A * | 4/1999 | Abtahi | B60Q 7/00 | 362/294 |
| 6,127,783 A * | 10/2000 | Pashley | F21V 23/0442 | 315/149 |
| 6,483,439 B1 * | 11/2002 | Vukosic | G08B 5/36 | 340/473 |
| 7,357,530 B2 * | 4/2008 | Wang | B64F 1/20 | 362/249.01 |
| 7,794,124 B2 * | 9/2010 | Hulsey | B63B 45/04 | 362/249.02 |

(Continued)

*Primary Examiner* — Jong-Suk (James) Lee
*Assistant Examiner* — Christopher E Dunay
(74) *Attorney, Agent, or Firm* — Royal W. Craig; Gordon Feinblatt LLC

(57) ABSTRACT

A self-monitoring LED marine navigation light that monitors LED intensity and if the intensity is not COLREG compliant, a microprocessor in the light simulates an open filament just as would an incandescent light, thus allowing the analog ships alarm panel circuit to trigger an alarm. The device generally comprises a base, a lens mounted to the base, and an LED module seated in the base and enclosed by the lens. The LED module includes primary and optional secondary LED lights plus one or more photodiode(s) exposed to the LED light(s). The LED also includes a processor and software for measuring light intensity input to the photodiode(s), comparing measured intensity to a minimum COLREG threshold, and signaling failure when measured intensity falls below said minimum threshold.

29 Claims, 10 Drawing Sheets

(56) References Cited

U.S. PATENT DOCUMENTS

| | | | | |
|---|---|---|---|---|
| 8,998,443 | B1 * | 4/2015 | Shumate | F21V 5/045<br>362/230 |
| 2008/0036616 | A1 * | 2/2008 | McDermott, Sr. | B60Q 11/005<br>340/657 |

* cited by examiner

SELF-MONITORING MARINE NAVIGATION LIGHT

CROSS-REFERENCE TO RELATED APPLICATION(S)

The present application derives priority from U.S. provisional application 62/707,815 filed 20 Nov. 2017.

BACKGROUND OF THE INVENTION

Field of the Invention

The present invention relates to marine navigation lights and, more particularly, to a dual-tier marine navigation light with remote infrared programming.

Description of the Background

All marine vessels are required by Coast Guard Regulation to carry sound signaling appliances and lights, including masthead light, sidelights, stern light, towing light, all-round light, flashing light, etc. The Convention on the International Regulations for Preventing Collisions at Sea (COLREGS) governs the intensity of navigation lights, requiring a minimum intensity in candelas according to a prescribed intensity formula, and a uniform intensity distribution such that the measured minimum and maximum luminous intensity values do not differ by more than a factor of 1.5.

Moreover, Resolution MSC.253(83) sets performance standards for navigation lights, navigation light controller and associated equipment, requiring a masthead light, sidelights and a stern light installed on board a ship not less than 50 m in length should be duplicated or be fitted with duplicate lamps, and that navigation light controllers be fitted onboard vessels to provide means of control and monitoring of the status of LED navigation lights onboard the vessel to the Officer of the Watch (00 W) or the manufacturer to specify practical term of validity. The problem with specifying the lifespan of the LED navigation light is that there is no way of determining if the LED navigation light is maintaining COLREG intensity requirements without monitoring the intensity of the LED.

LED marine navigation lights are gaining popularity due to their energy efficiency and long lifetime, but LEDs present special problems that compel special requirements for navigation lights using LEDs. There needs to be an alarm to notify the Officer of the Watch that the luminous intensity of the light has been reduced below the level required by COLREGs. The intensity of conventional incandescent lights depends on electrical current, and so conventional navigation control panels monitor current and trigger an alarm when they detect an open filament. The problem is that a LED navigation will not fail the same way as an incandescent light. With a LED navigation light, the intensity diminishes over time but without a reduction in current. Therefore, conventional navigation control panels cannot detect a non-compliant LED navigation light that does not meet the COLREGs requirement. This is becoming a substantial problem as more and more passenger vessels and large vessels are converting from incandescent to LED navigation lights while keeping their conventional navigation control panels designed for incandescent lights. This creates another problem. There is no easy way to modify an incandescent control panel for the lower currents of the LED navigation light to prevent false trigging of the alarm. A more expensive option is to replace the original control panel entirely with a new one designed for LED navigation lights, but whether new or modified there is no existing solution to the problem of detecting a non-complaint LED navigation light due to the inherent decrease of LED intensity without any commensurate decrease of current. What is needed is a self-monitoring LED navigation light that simulates an open filament by turning off the current to the light to trigger the existing alarm panel into seeing it as an incandescent light and sending requisite alarms.

SUMMARY OF THE INVENTION

Accordingly, it is an object of the invention to provide a self-monitoring LED navigation light that self-monitors the candelas requirement as specified in the COLREGs, and imitates the failure mode of an incandescent light upon failure. If the intensity is not COLREG compliant, a microprocessor in the light simulates an open filament just as would an incandescent light, thus allowing the analog or digital ships alarm panel circuit to trigger an alarm. These analog alarm panels monitor the lights current, or lack of current to trigger an alarm.

It is another object to provide an autonomous navigation light that complies with IMO Resolution 253(83)4.3.1 (monitors intensity) and 4.3.2 (counts end of life hours for the light).

It is another object to provide an autonomous double head navigation light, alternating light heads at startup (doubling the lifetime), and always ensuring a working backup light. If the monitored intensity of one light head fails to meet 72 COLREGs, the device automatically switches light heads to the known-good back up.

It is another object to provide an autonomous navigation light that verifies all components every day at start up to ensure 72 COLREGS requirements are compliant.

It is another object to provide an autonomous navigation light with two way communication between the light and the switch panel.

Another object of this invention is to improve upon the devices of the prior art by providing an assembly that is light in weight, weatherproof, solid in construction, modular, reliable, simple to manufacture, and easy to maintain with only minimal maintenance requirements.

These and other objects are accomplished with a marine navigation light comprising a base, a lens mounted to the base, and an LED module seated in the base and enclosed by the lens. The LED module further comprises an erect support member having at least one flat facing, or two or more diametric facings, each facing extending up from a horizontal shoulder. Primary and optional secondary LED lights are mounted in each facing of the support member. At least one photodiode is mounted below each facing in the shoulder of the support member for upward exposure to the primary/secondary LED light(s). The LED module contains an internal electronic module containing one or two LED drivers (for primary/optional secondary LED light(s)) and a processor and software for measuring light intensity created thereby and input to the corresponding photodiode(s), comparing measured intensity to a minimum COLREG threshold, and signaling failure when measured intensity falls below said minimum threshold. Upon detection of substandard intensity the processor simulates on open incandescent filament by turning off the current to the faulty LED, which appears to the existing alarm panel as a blown-out incandescent light so that the existing alarm panel will send the requisite alarm.

DESCRIPTION OF THE DRAWINGS

Other objects, features, and advantages of the present invention will become more apparent from the following detailed description of the preferred embodiment and certain modifications thereof, in which.

DETAILED DESCRIPTION

The present invention is an LED navigation light that self-monitors the candelas requirement as specified in the COLREGs and can determine a non-compliant navigation light and respond accordingly: single head non-compliant—notify and leave LED ON; double/redundant heads non-compliant notify and turn LED OFF; autonomous double head non-compliant notify and switch heads. For double/redundant light, the processor imitates the failure mode of an incandescent light upon failure. If the intensity is not COLREG compliant, a microprocessor in the light simulates an open filament just as would an incandescent light, thus allowing the analog ships alarm panel circuit to trigger an alarm. In addition, the autonomous device alternates light heads at startup, thereby doubling the LED life, and if the monitored intensity of one light head fails the device automatically switches light heads to the known-good back up.

Figure 2:
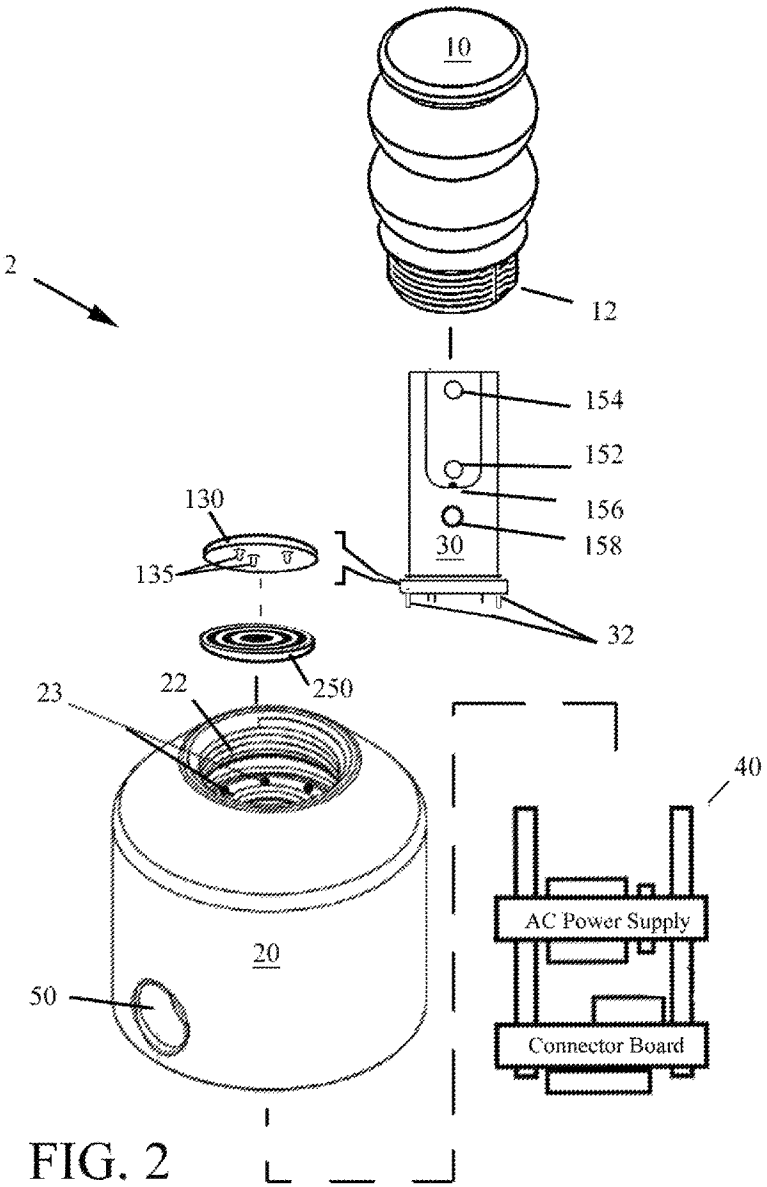
FIG. 2 is an exploded assembly drawing of the marine navigation light 2 of FIG. 1.
Figure 1:
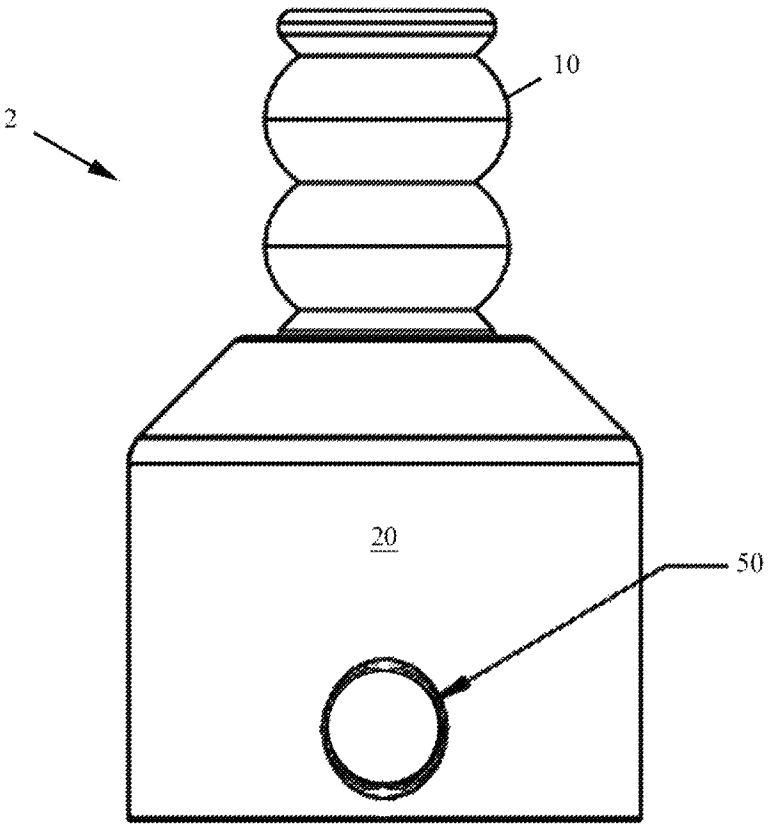
FIG. 1 is a front view of the self-monitoring marine navigation light 2 according to an embodiment of the invention.

FIG. 1 is a front view of the self-monitoring marine navigation light 2 according to a double-head embodiment of the invention, and FIG. 2 is an exploded perspective view. With combined reference to FIGS. 1-2 the marine navigation light 2 generally comprises a lens 10, a base 20, an internal LED module 30, a centric (bull's eye) PCB 250 seated below the base of the LED module 30, and an internal power supply/connector module 40 housed in the base 20 and inserted upward therein from below. The base 20 is preferably a machined cylindrical aluminum housing with one or more side apertures each for mounting a UL/CE IP68 strain relief. The base 20 is machined with a frusto-conical upper end tapering to an internally-threaded internal cavity. The internal power supply/connector module 40 is disc-shaped and sized to fit upward into the bottom base 20 cavity. The power supply/connector module 40 provides the connection point for ship's power plus any necessary power regulation and conversion circuitry. Since ship power systems differ the power supply/connector module 40 may take several different forms, depending on input voltage, and may be single-tier, double-tier (as shown) or more. Power cables are connected thereto through one or two IP68 strain relief(s) 50, two being used for redundancy to a double head unit as defined below. The bottom of the LED module 30 includes a flange containing two downwardly-protruding alignment pins 32 that fit within corresponding alignment holes 23 formed in the mouth of base 20. The LED module 30 also has a spring-contact circuit board 130 embedded in the flange and downwardly exposed therefrom, wielding a plurality of protruding spring-detent contacts 135. A centric bull's eye PCB 250 is nested in the mouth of base 20 beneath the LED module 30, and the centric bull's eye PCB 250 keeps secure electrical contact between the LED module 30 and internal power supply/connector module 40 housed in the base 20 below. For assembly, the centric bull's eye PCB 250 is seated first in the mouth of base 20 and then the LED module 30 is inserted down into the upper cavity of base 20 and makes electrical contact therewith via spring-detent contacts 135. Alignment pins 32 protruding down from the base of the LED module 30 index alignment holes 23 in the mouth of the base 20 for seating and alignment of the LED module 30 in the mouth of base 20 in one of four angular positions, and this indexes contacts 135 into proper connection with the centric bull's eye PCB 250. The lens 10 is a polycarbonate enclosure that includes external threads that screw into the base 20, compressing the LED module 30 against the base 20 providing a good thermal heat transfer. This configuration allows ready access to the LED module 30 and centric bull's eye PCB 250 simply by unscrewing the lens 30 and popping out the LED module 30. A silicon O-ring 16 is seated inside the mouth of base 20 and seals against the lens 10. The O-ring maintains constant pressure between lens 10 and base 20 for the IP67 rating and effectively sinks heat away from the LED module 30.

Figure 4:
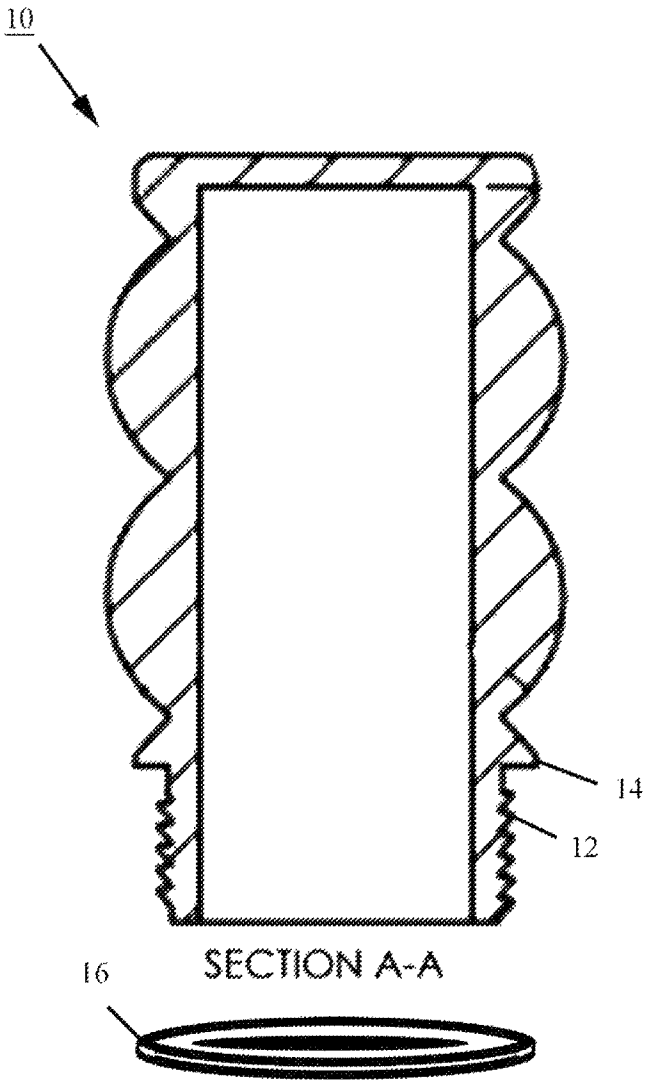
FIG. 4 is a cross-section of lens 10 taken along the lines A-A' of FIG. 3.
Figure 3:
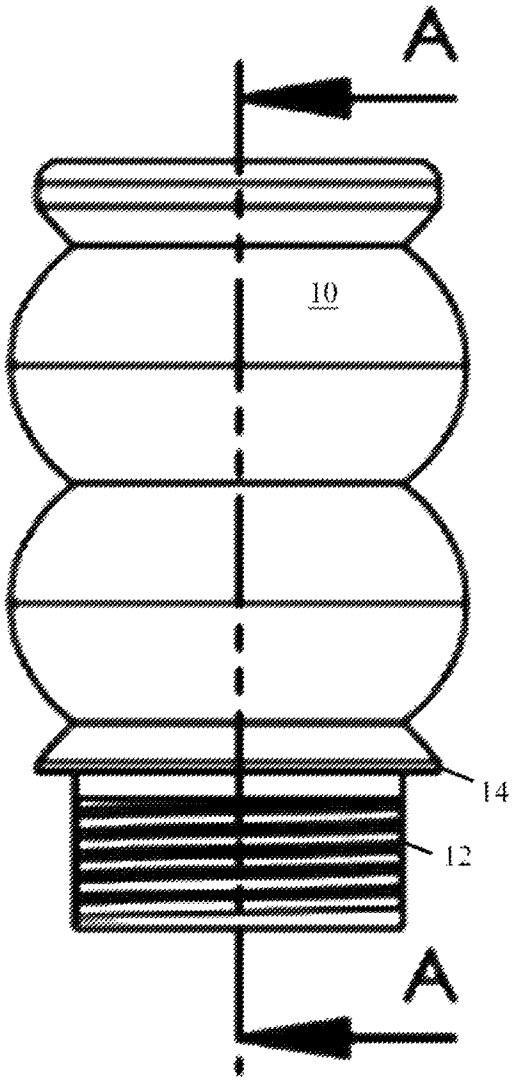
FIG. 3 is a front view of the lens 10.

FIGS. 3 and 4 are a front view of the lens 10, and a cross-section taken along lines A-A'. Lens 10 is preferably an injection molded UV-stable poly carbonate material formed with a cylindrical interior chamber and a double-parabolic external configuration. A flange 14 encircles the base of the parabolic section that compresses the silicon O-ring 16 to the base 20. A screw collar protrudes downward and is formed with high loading buttress threads 12 to unscrew and replace. The buttress threads 12 allow the lens 10 to be screwed down tightly onto a silicon O-ring 16 that mates with the aluminum base 20 O-ring bevel. The machined bevel is designed with the proper angle used for the underwater IP67. The lens 10 double parabolic serves two functions. First, it increases the intensity of the LED module 30. Secondly, the vertical divergence of the parabolic design maintains the brightness at 100% of horizontal intensity exceeding the +5 and 5 degrees as required by the COLREGs. This increased ability to maintain full brightness while the vessel is healing provides additional visibility for safety. However, one skilled in the art should understand that the lens 10 is meant to be interchangeable and may be replaced with other external configurations without departing from the scope or spirit of the invention.

Figure 5:
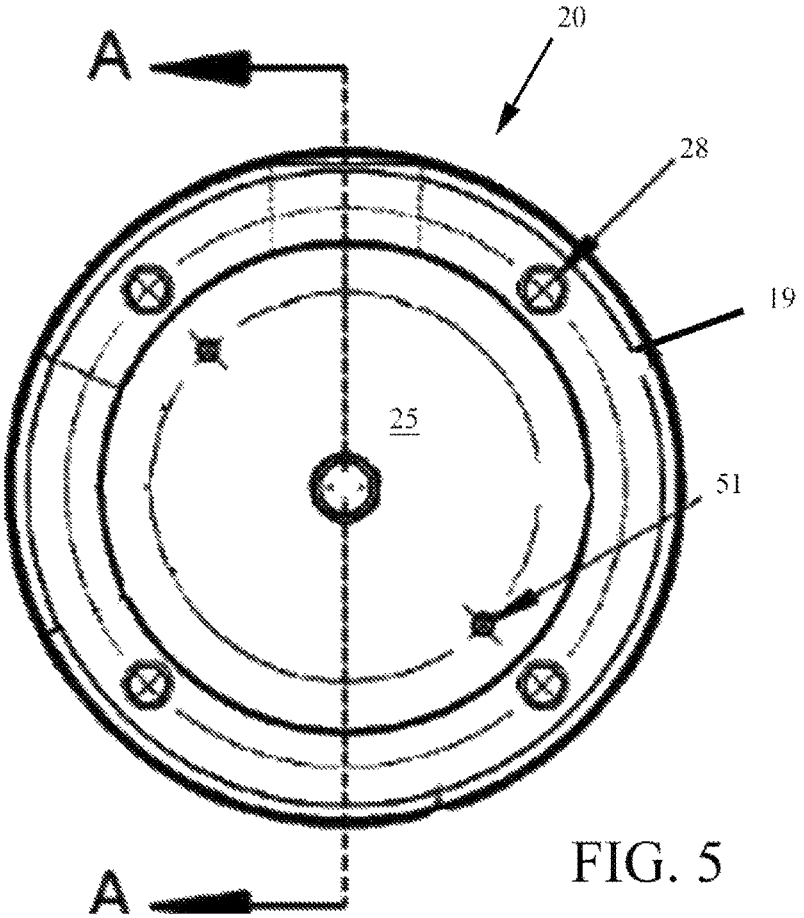
FIG. 5 is a bottom view of the base 20.
Figure 6:
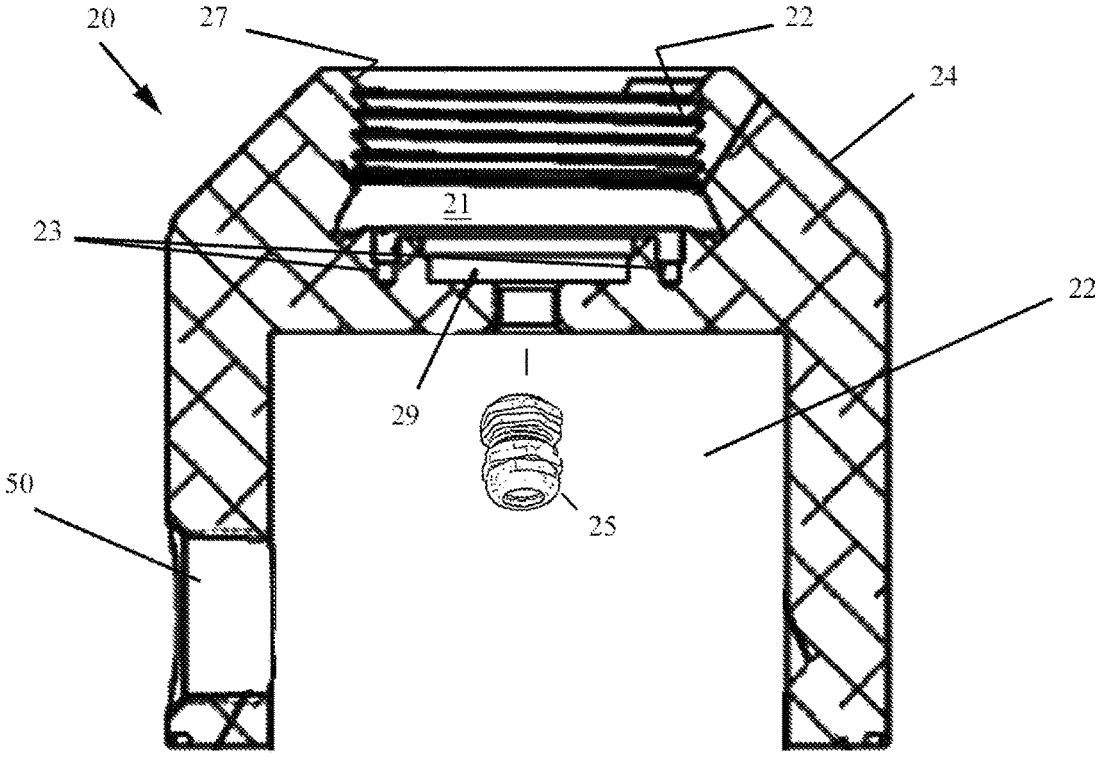
FIG. 6 is a cross-section of base 20 taken along the lines A-A' of FIG. 5.

FIGS. 5 and 6 are a bottom view of base 20 and a cross-section taken along the lines A-A'. The base 20 is preferably machined aluminum 6061 T6 grade with a clear natural hardcoat MIL-A-8625F Type 3 CL1 AMD 1 finish with a cylindrical bottom cavity 22 for enclosing the internal power supply/connector module 40. The base 20 is machined with a frusto-conical upper surface 24 tapering upward to the mouth which opens to the internally-threaded upper cavity 24. The input port/port(s) 50 prevent moisture ingress for a single or double water tight strain relief that may be ½" NPT. If desired, the bottom cavity 22 provides ample room for an optional silicon thermal heater for artic conditions. As seen in FIG. 5, the bottom of base 20 has four ¼-20 female-threaded holes 28 which allow the navigation light 2 to be mounted directly to a mounting plate on the vessel, or to an adapter plate for mounting to any existing hole patterns. There is also a machined groove 19 for an O-ring that provides the IP67 rating from the bottom of base 20 to the mounting plate therein. Additional screw-holes 51 are provided to mount the stand-offs for the power supply/connector module 40 thereto in the base cavity 22. The upper cavity comprises a fluted surface 27 providing a seat for O-ring 16, surface 27 leading to internal buttress threads 22 for screw-insertion of lens 10. Beneath the threads 22 the upper cavity is formed with a circular moisture reservoir 21 to draw moisture away from the LED module 30. The four alignment holes 23 are spaced at angular intervals about the floor of the moisture reservoir 21 for seating and alignment of the pins 32 of LED module 30. Below the moisture reservoir 21 a recess 29 is provided for sealing and seating the centric (bull's eye) PCB 250 that mates to the spring contacts 135 that connect power from the power supply/connector board 40 to the LED module 30. The centric (bull's eye) PCB 250 is a circular PCB with three concentric circular traces on its upper surface, these connected by three-wire cable running from the lower side. The centric (bull's eye) PCB 250 mates to the spring-contact circuit board 130. In addition, an IP68 strain relief 25 allows the cable from the centric bull's eye PCB 250 to pass through into the chamber 22 of base 20 providing a water tight seal. The recess 29 provides the proper tolerance to allow the LED module 30 and spring-loaded contacts 135 to mate to the centric bull's eye PCB 250. Recess 29 also allows a secondary seal to prevent moisture from getting into the LED modular area while providing proper thermal transfer between the LED module 30 and the base 20. Thermal grease may be applied to the mating surfaces to enhance the heat transfer. This grease also aids in the prevention of moisture ingress between the LED module 30 and the base 20, maintaining the requisite IP67 standard. The moisture reservoir 21 collects any moisture entering the light, should the lens 10 be removed during precipitation. The four small alignment holes 23 are preferably positioned at 90-degree intervals to allow orientation of the LED module 30 with the centerline of the vessel, and to index the desired exit of the cables. These alignment holes 23 allow the machined pins 32 on the bottom of the LED module 30 to only fit in one of four 90 degree orientations. Once the LED module 30 drops down into the holes 23, the spring-loaded pins 135 will contact the centric (bull's eye) PCB 250. The UV stable lens 10 with silicon O-ring 16 are then screwed down to secure the LED module 30 to the base maintaining the proper pressure for good thermal management while maintaining the IP67 rating.

Figure 8:
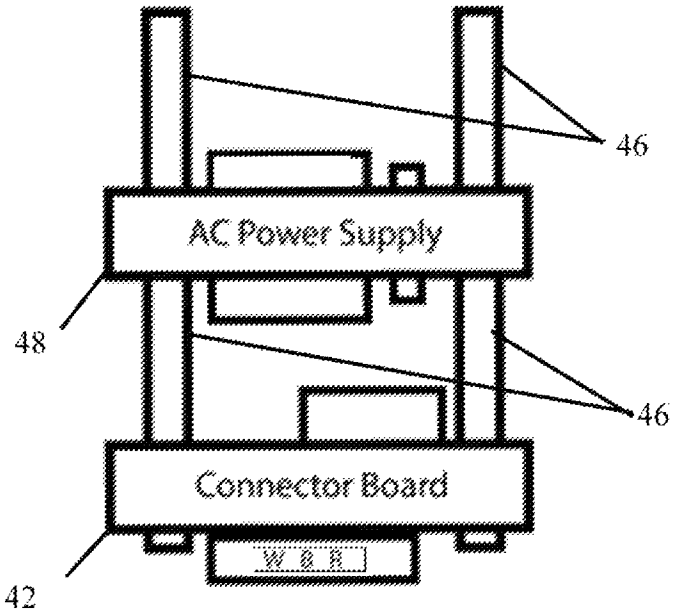
FIG. 8 is a side view of the power supply/connector module 40.
Figure 7:
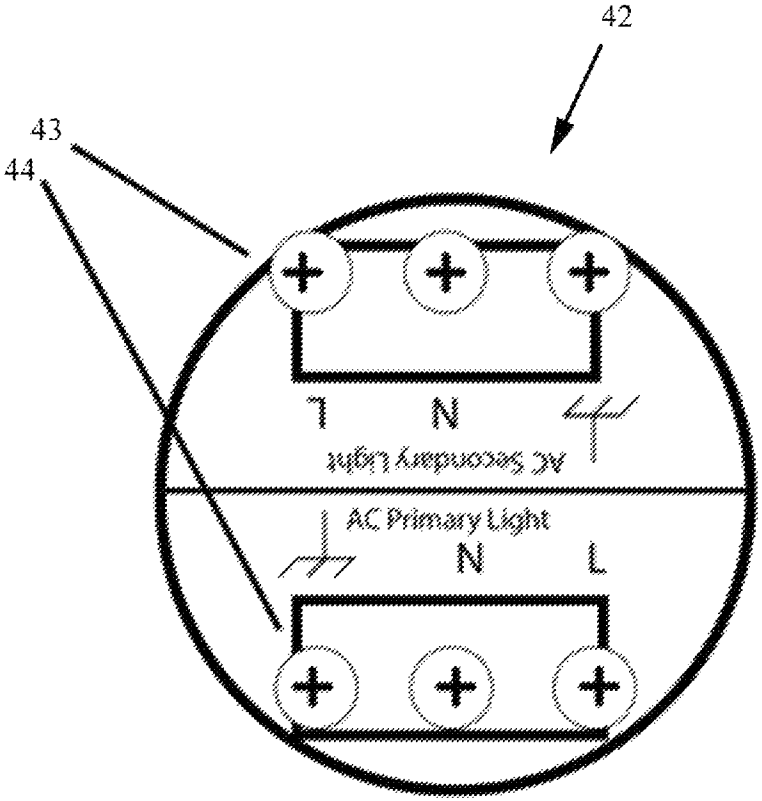
FIG. 7 is a bottom view of the power supply/connector module 40.

FIG. 7 is a bottom view of an embodiment of the power supply/connector module 40. The power supply/connector module 40 comprises one or more disc-shaped PCBs coaxially-mounted on stand-offs. Electrically, the power supply/connector module 40 may take several different configurations depending on input voltage requirements of the vessel. LED navigation lights commonly operate in discrete voltage ranges depending on the requirements and may be AC or DC. The present navigation light 2 can operate on multiple input powers (12-40 VDC or 120-240 VAC). Thus, different UL 1104 approved power supply/connector module 40 configurations are available to suit these needs, supplying DC voltage to the LED module 30 from any of 4-40 VDC in either a single or double head; 120-240 VAC in a single or double; or AC/DC combined voltages. All such versions at least include a circular terminal connector PCB 42 as shown in FIG. 7 with three connections per light head. Thus, for a two head unit the circular terminal connector PCB 42 shown in FIG. 7 is bisected into a primary LED connector (bottom) and secondary LED connector (top), each comprising three wire connectors two for AC power and one for ground (or positive, negative and ground for DC). For a two head AC unit the circular terminal connector PCB 42 shown in FIG. 7 is mounted on standoffs 46 as shown in FIG. 8 concentrically with a circular power supply PCB 48 of similar dimensions. The circular power supply PCB 48 comprises conventional power supply circuitry for producing the appropriate DC voltage for each head of the LED module 30 from the given AC or DC source and input power range.

The above-described circular power supply PCB 48 supplies power directly to the LED module 30 via the centric (bull's eye) PCB 250.

Figure 10:
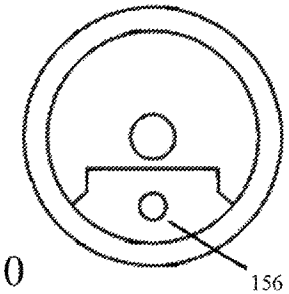
FIG. 10 is an enlarged top view of the LED module 30.
Figure 11:
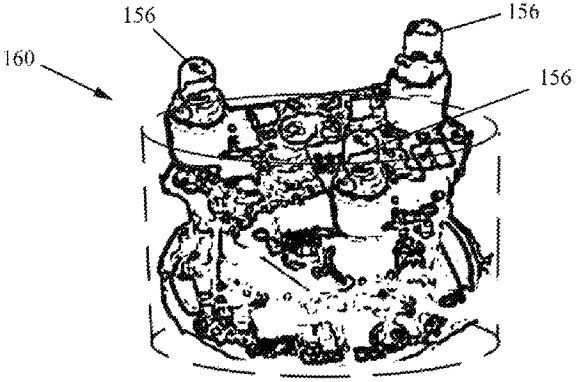
FIG. 11 is a perspective view of the main electronics module 160 inside the LED module 30.
Figure 12:
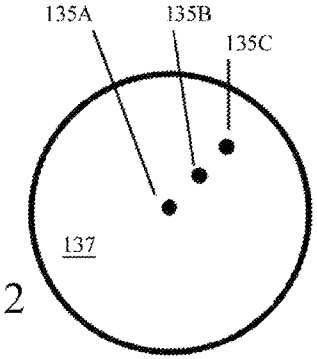
FIG. 12 is a bottom view of the LED module 30.
Figure 9:
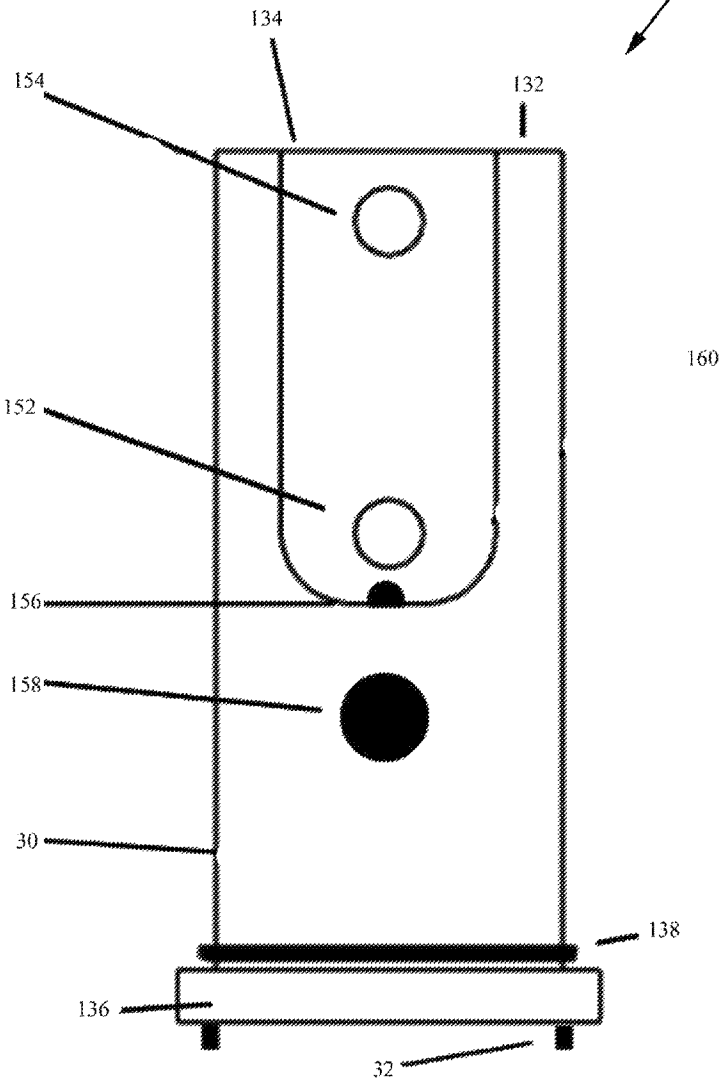
FIG. 9 is an enlarged side view of the LED module 30.

FIGS. 9, 10 and 12 are an enlarged side view, top view and bottom view, respectively, of the LED module 30, and FIG. 11 is a perspective view of the main electronics module 160 inside the LED module 30. The LED module 30 generally includes a cylindrical aluminum machined housing 132 with one-to-three vertically-cut facings 134 providing internal cutoff angles of 112.5, 135, 225, 360 and leading downward to a horizontal shoulder and photodiode 156. The cylindrical housing 132 continues downward to a circular bottom flange 136. The flange 136 encapsulates or houses the spring-loaded contact PCB 130. The two alignment pins 32 are machined pins in the bottom that protrude downward for insertion into the corresponding holes 23 in the mouth of base 20. Once seated therein spring-loaded pins 135A-C protruding from the bottom of the LED module 30 spring-contact circuit board 130 contact the centric bull's eye PCB 250. In turn, spring-loaded pins 135A-C bring power to the LED module 30. Thus, the spring-contacts 135A-C provide DC Ground, a primary DC Input, and a secondary DC Input to the LEDs 152, 154. A Primary LED 152 is affixed within a machined alignment recess in the vertical facing 134, and a Secondary LED 154 is likewise affixed within a machined alignment recess just above. An LED intensity sensing photodiode 156 is affixed within a machined alignment recess on horizontal shoulder 156 and is upwardly exposed the both LEDs 152, 154. An infrared (IRDA) programming port 158 enters the housing 132 beneath the facing 134. A silicon O-ring 138 is preferably seated atop the flange 136 to seal against the lens 10. For clarity, "single-head" is herein defined as a single lighting circuit in which LED module 30 includes one primary LED 152 connected by a single cable entry through a single port 50 in housing 20. "Double-head" is herein defined as a double redundant lighting circuit in which LED module 30 includes one, two or three primary LEDs 152 and one, two or three secondary LEDs 154 diametrically mounted along opposed facings 134 and connected by two redundant cable entries through two ports 50 in housing 20. "Autonomous double-head" is herein defined as a double lighting circuit in which LED module 30 includes one, two or three primary LEDs 152 and one, two or three secondary LEDS 154 diametrically mounted along opposed facings 134 can connected by one cable entry through one port 50 in housing 20.

Inside the LED module 30 there resides a main electronics module 160 (FIG. 11) containing a microprocessor-based LED controller with intensity sensing circuitry connected to photodiode(s) 156, IRDA sensing circuitry connected to IRDA port 158, and LED driving and control circuitry connected to Primary LED 152 and Secondary LED 154. The main electronics module 160 is preferably potted in a cylindrical form (shown by dotted lines for sealed insertion inside the housing 132 of LED module 30. As seen in FIG. 12 the three spring-loaded pins 135A-C protrude there beneath.

In operation, the processor in main electronics module 160 executes a power-on initiation routine by which it runs an IRDA status update to see if any IRDA signal is present at IRDA port 158 for programming or status. If no IRDA status is present, the processor will enable the Primary LED(s) 152 or Secondary LED(s) 154 to come on, and then begin a monitoring routine. Once the LED is on, the intensity of the LED is monitored at photodiode 156 and compared to COLREG requirements. Depending on the light configuration, the light will communicate to the operator/panel of a non-compliant navigation light.

The microprocessor-based main electronics module 160 is programmed with control software comprising computer instructions stored on flash memory for carrying out an initialization and monitoring sequence.

Figure 13:
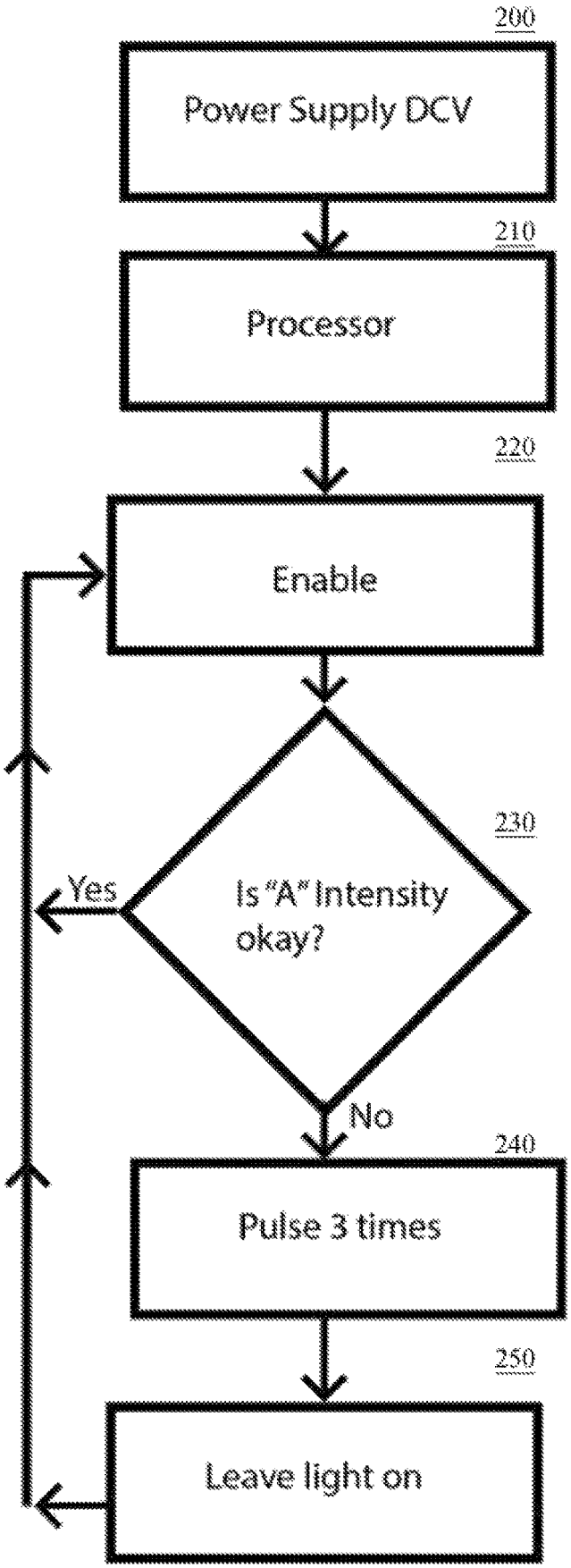
FIG. 13 is a flow diagram of the LED controller 160 software sequence for a single head navigation light and a single head with back up head.
Figure 14:
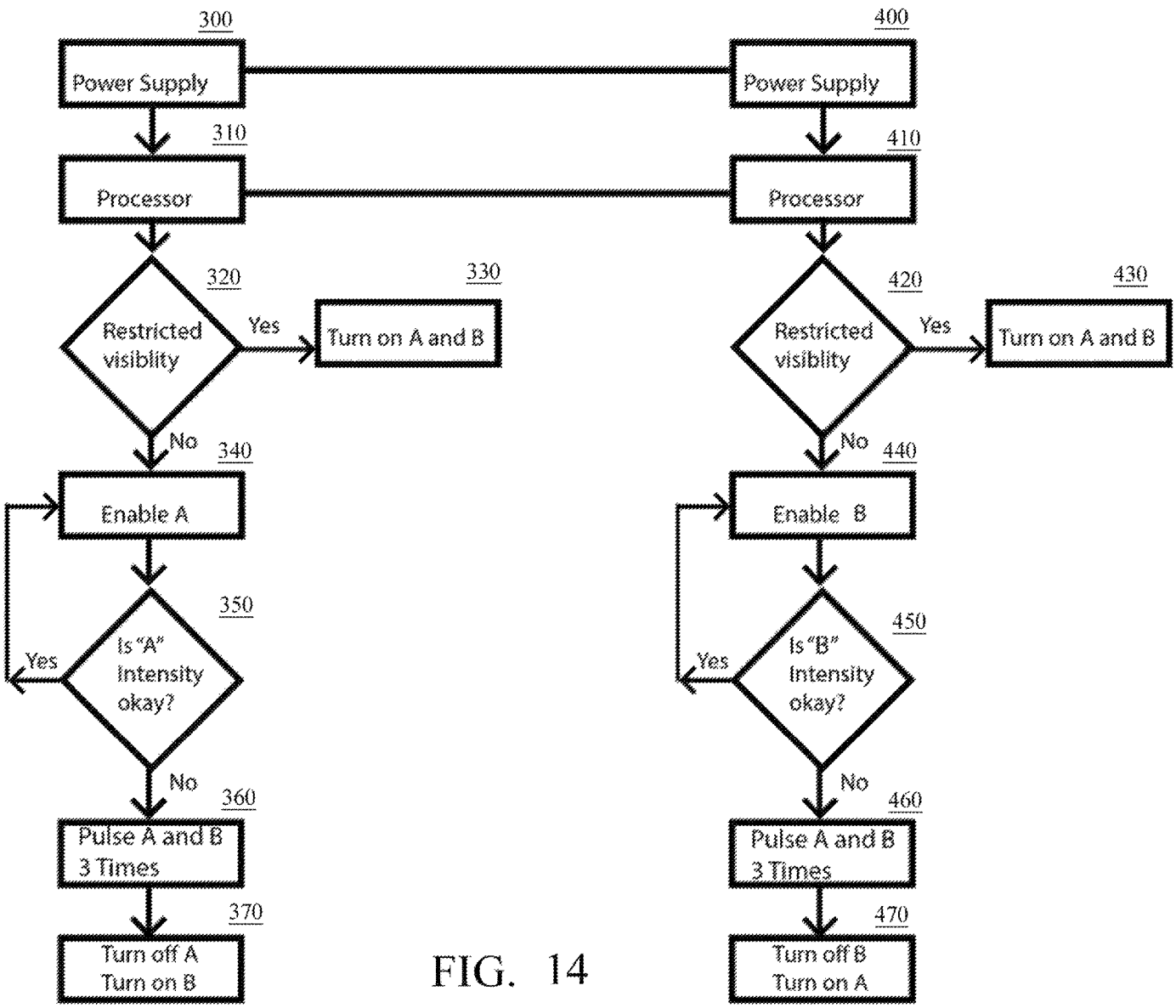
FIG. 14 is a flow diagram of the LED controller 160 software sequence for a double head autonomous navigation light.

FIG. 13 is an example of this sequence for a single head navigation light.

At step 200 power is applied to the main electronics module 160.

At step 210 the main electronics module 160 initiates an IRDA status update, polling if any IRDA signal is present at IRDA port 158 for programming or status. At step 220 if no IRDA status is present, the processor will enable the Primary LED(s) 152 to come on. At step 230 once the LED(s) is/are on, the intensity of the LED(s) are monitored at photodiode 156 and compared to COLREG requirements. If intensity is sufficient monitoring continues. If not, then at step 240 main electronics module 160 will communicate to the operator/panel a non-compliant navigation light 2 by flashing the light three times for visual notification and triggering an alarm three times at the main alarm panel. On a vessel that requires redundant backup navigation lights, the operation of main electronics module 160 is the same as a single head, except if the light is not COLREGs complaint, the processor will turn off the head triggering the alarm. The vessel operator will now have to manually switch over to the backup head.

The foregoing sequence is more involved for an autonomous double head navigation light, and FIG. 13 shows this as the processor of main electronics module 160 employs a dual-head monitoring scheme.

At steps 300, 400 power is applied to the main electronics module 160.

At steps 310, 410 the processor of main electronics module 160 initiates the IRDA status update, polling if any IRDA signal is present at IRDA port 158 for programming or status. At steps 310, 410 if no IRDA status is present, the processor of main electronics module 160 will enable one of Primary LED(s) 152 or Secondary LEDs 154 in one of the light heads to come on, again preferably different from the last used. At steps 320, 420 the main electronics module 160 checks for a restricted visibility indication of three pulses within six seconds from the navigation control panel (or an existing navigation light master power switch). Given this indication, the main electronics module 160 turns on both light heads in accordance with COLREGs. If at steps 320, 420 the processor in main electronics module 160 finds no restricted visibility indication from the navigation control panel, the processor turns on one light head, and at steps 350, 450 the intensity of the selected LED is monitored at photodiode(s) 156 and compared to COLREG requirements. If intensity is COLREG compliant, monitoring continues. If not, then at steps 360, 460 main electronics module 160 will communicate to the operator/panel a non-compliant navigation light.

At steps 360, 460 if the light intensity falls below COLREG on either head, the processor of main electronics module 160 will flash both heads three times for visual notification, triggering the alarm 3 times for alarm panel, then steps 370 or 470 automatically switches heads to the other head. The application software that runs the processor of main electronics module 160 is remotely upgradeable via IRDA port 158 and allows a programmer to choose a variety of parameters for the light: single or double head; type of light: port, starboard etc.; alarm trigger points; hours of use; flash rates; ambient light conditions. The programming is accomplished using IRDA from a remote computer to the photodiode 156 of LED module 30. Once the parameters are uploaded to the application program, the transfer of data will be sent via sensing circuitry connected to IRDA port 158.

The IRDA port 158 is bi-directional and can read out the stored memory from the EEPROM on the LED module 30. The IRDA port 158 can read and display real time microamp currents from the optical diode circuitry to a remote computer. This allows realtime testing and debugging operations to be performed from an adjacent computer with an IRDA transceiver. To calibrate the circuit, the navigation light 2 is placed in a sealed test chamber with external power supply and LED light source to provide a known given amount of intensity. When the processor of main electronics module 160 is to be programmed, the first step is to allow the optical diode circuitry 156 to read the light intensity in microamps in the test chamber without the LED light under test illuminated. This is performed on one up to three of the optical diodes on the LED module 30. This allows the optical diode circuitry to read the microamps from 1, 2, or 3 optical diodes (depending on the light configuration). This step determines the gain of the linear diodes.

The application program then determines any differences in gain between optical diodes 156. Next, the application program needs to scale or adjust the values either up or down in relation to the individual diode gains. The application program will increase the value of a low gain diode and decrease the value of a high gain diode. The goal is to adjust the values used in the application offset tables that are used to compare to the actual intensity of the LED module.

The LED module 30 can be manually calibrated versus using the test chamber. The IRDA transfers and displays the real time microamps intensity from the optical diode circuitry to the application computer. This allows the calculations to be performed based on the certified candela intensity obtained during the UL 1104 certification.

The following is a formula that can be used to calculate the alarm setting:

Alarm point=(calculated alarm)/(certified candelas)× (measured microamps from application program)

As an example: a three nautical mile port light requires 12 candelas. A third-party test lab has required the alarm set point to be no lower than 11.9 candelas.

Thus, Alarm point=11.9 candelas/22.5 candelas or 0.53× measured microamps from the application program.

The IRDA communication capability allows the microamp intensity to be displayed on the application computer. To test the LED intensity monitoring, the lens 10 is removed, and the proper attenuation filter is placed over the monitoring diode 156. This attenuation of the LED intensity will cause the real time microamp current displayed to be reduced below the alarm set point.

Figure 15:
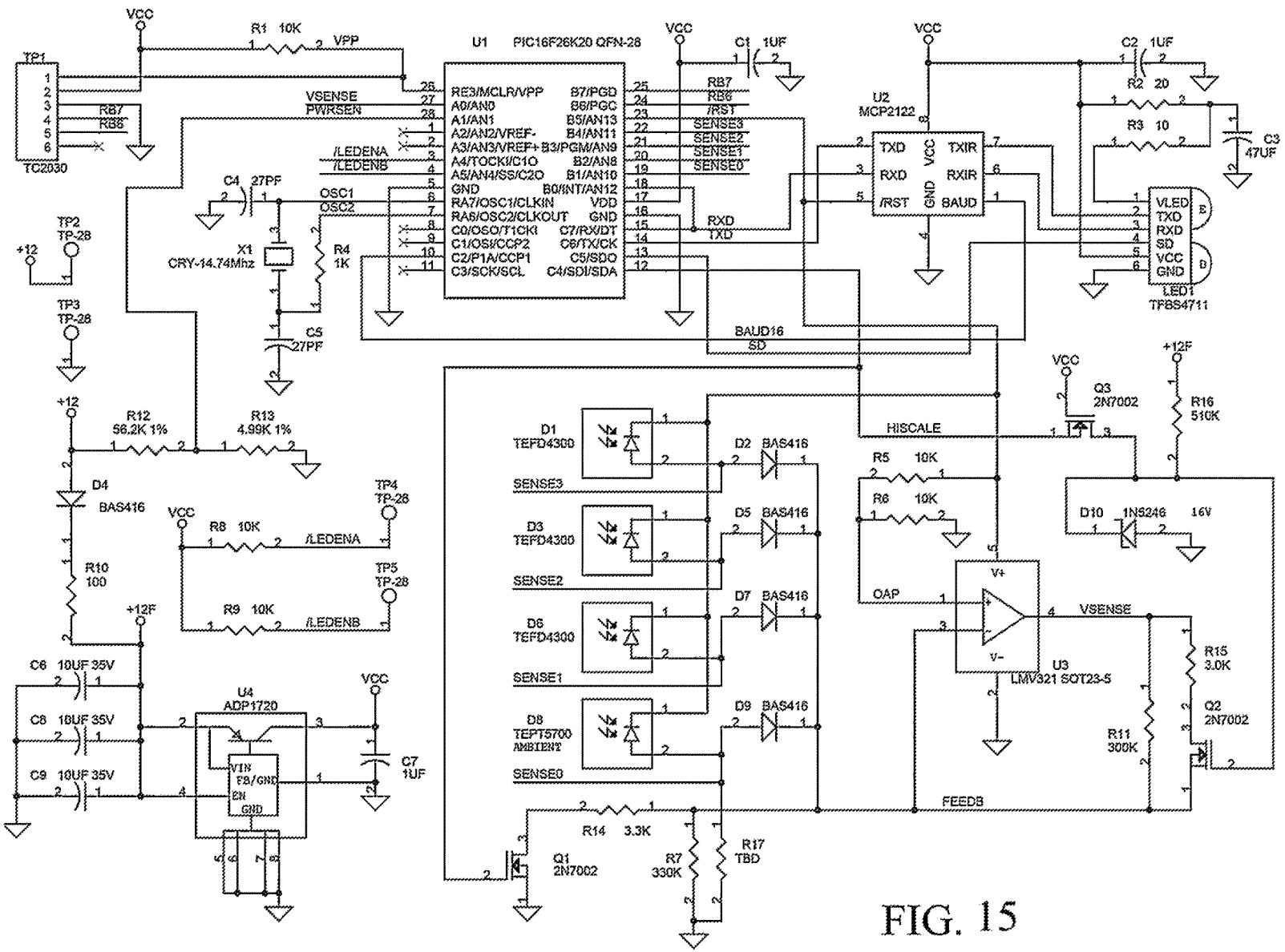
FIG. 15 is a detailed schematic diagram of the microprocessor-based LED controller 160.

After nine seconds of reduced LED intensity below the alarm set point, the LED module 30 will indicate non-compliant COLREG LED intensity as per above. For completeness of disclosure, FIG. 15 is a detailed schematic diagram of the microprocessor-based main electronics module 160 incorporating processor U1 which is a PIC16F-E/ML flash-based, 8-Bit CMOS microcontroller, complete with intensity sensing circuitry comprising four sensing photodiodes D1, D3, D6, D8 dedicated to the photodiode sensing circuit for the LED intensity monitoring of a three LED unit, where D1, D3 and D6 represent photodiodes 156 and photodiode D8 is used to sense the ambient light condition for dusk to dawn operation. The processor U1 communicates through an U2 IrDA standard encoder/decoder device working through IRDA photodiode 158 (LED1) which is a Vishay® TFBS4711 15.2 kbs (SIR) IRDA Transceiver wired as shown. The circuit represents the processor of a three-photodiode diametric for both primary and secondary LEDs 152, 154. D1, D3, D6 In operation, the fault signal originates at the sensing photodiode 156 (D1, D3, D6) which has a micro current generated by the LED 152, 154 intensity. The lower LED 152 will have a higher current than the upper head due to the proximity to the LED 152 to photodiode 156. These small generated signals from the photodiodes 156 (D1, D3, D6) are sent to an op-amp circuit U3 to be amplified to be read by the analog-to-digital converter. This digital value is used to compare to the stored alarm points within the double EEPROM on the processor U1.

Regardless of which LED 152, 154 lower or upper head) is lit the processor determines which table to compare the values against. The processor U1 is always looking for a signal from the alarm panel as an indication of the requirement to turn both LED heads for restricted visibility.

Figure 16:
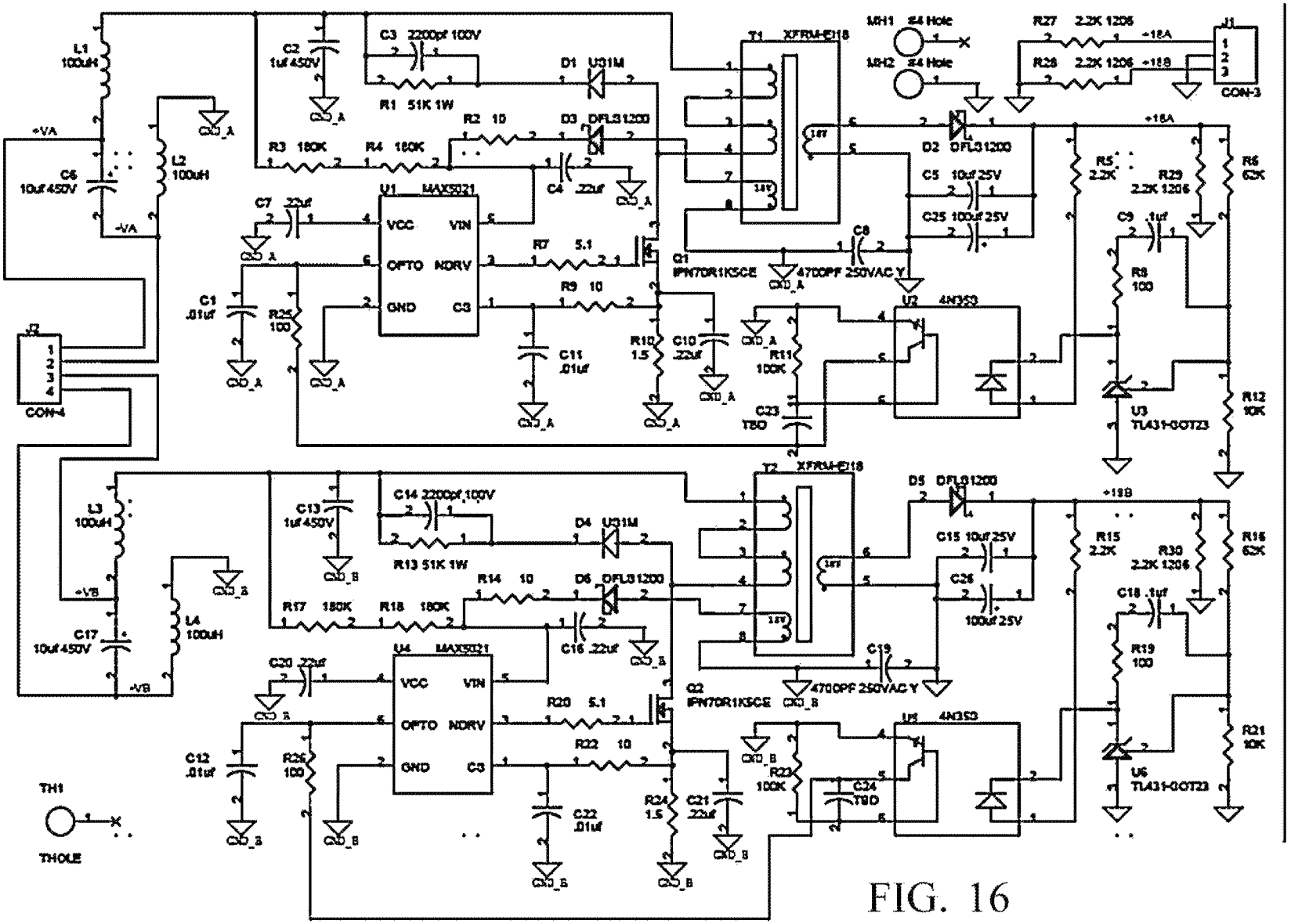
FIG. 16 is a detailed schematic diagram of an exemplary dual AC power supply suitable for the power supply/connector module 40 of FIG. 7.

FIG. 16 is a detailed schematic diagram of an exemplary dual AC power supply suitable for the power supply/connector module 40 of FIG. 7. The power supply relies on Maxim Integrated MAX5021 Series Switching Controllers.

Figure 17:
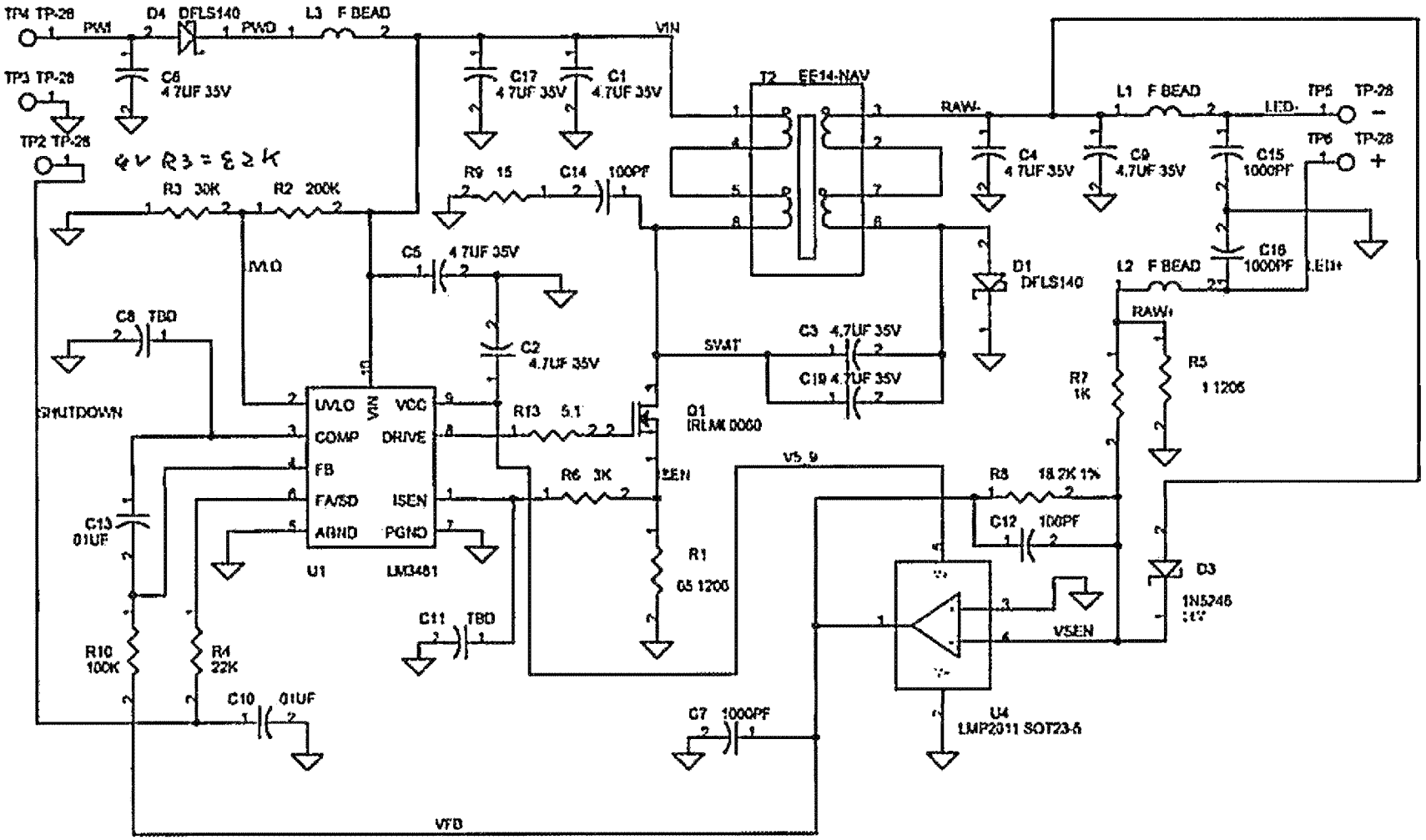
FIG. 17 is a detailed schematic diagram of an exemplary LED driver circuitry resident on main electronics module 160.

FIG. 17 is a detailed schematic diagram of an exemplary LED driver circuitry resident on main electronics module 160 for powering both Primary LED 152 and Secondary LED 154 via switching regulator based on an LM3481 controller. It should now be apparent that the above-described self-monitoring LED navigation light automatically maintains compliance with the COLREGs, thus allowing any analog or digital ships alarm panel to trigger an alarm when LED intensity drops below spec. If the monitored intensity of one light head fail to meet 72 COLREGs, the device automatically switches light heads to the known-good back up. The light complies with IMO Resolution 253(83)4.3.1 (monitors intensity) and 4.3.2 (counts end of life hours for the light), plus it alternates light heads at startup doubling the lifetime, and always ensures a working backup light. Moreover, the light is processor-based and maintains two way IRDA communication with the switch panel and/or remote computer. The physical assembly is light in weight, weatherproof, solid in construction, modular, reliable, simple to manufacture, and easy to maintain with only minimal maintenance requirements.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A marine navigation light, comprising:

a base;

a lens mounted to the base;

an LED module seated in said base and enclosed by said lens, said LED module further comprising, a support member, at least one LED light mounted on the support member, at least one photodiode mounted on the support member and exposed to said at least one LED light, and an electronic module mounted in said support member and comprising one or more printed circuit boards containing circuitry including at least an LED driver circuit, a processor, and non-transitory computer-readable storage device storing a monitoring software module comprising a series of computer-readable instructions for monitoring an intensity of said at least one LED light mounted in the facing of said support member by the steps of, measuring light intensity at said photodiode of the at least one LED light mounted on the support member, automatically comparing at said processor said measured intensity to a minimum threshold, signaling a failure when said measured intensity falls below said minimum threshold.

2. The marine navigation light according to claim 1, wherein said support member comprises a cylinder having a flat facing intersecting a shoulder.

3. The marine navigation light according to claim 2, wherein said at least one LED light is mounted on the facing of said support member.

4. The marine navigation light according to claim 3, wherein said photodiode is mounted on the shoulder of said support member.

5. The marine navigation light according to claim 2, wherein said support member has a plurality of diametric flat facings and shoulders, wherein said at least one LED light is mounted on each flat facing, and wherein said at least one photodiode is mounted on each shoulder.

6. The marine navigation light according to claim 5, wherein said support member is generally cylindrical except for said plurality of flat facings and shoulders.

7. The marine navigation light according to claim 2, wherein said support member flat facing is perpendicular to said shoulder.

8. The marine navigation light according to claim 1, wherein said base is cylindrical with a screw-threaded mouth and said lens is externally-screw-threaded for insertion into said base.

9. The marine navigation light according to claim 8, wherein said lens is single-parabolic.

10. The marine navigation light according to claim 9, wherein said monitoring software module comprises a series of computer-readable instructions for alternating use between two LED lights at startup.

11. The marine navigation light according to claim 8, wherein said lens is double-parabolic.

12. The marine navigation light according to claim 1, wherein said electronic module further comprises a transceiver for data communication with said processor.

13. The marine navigation light according to claim 12, wherein said electronic module further comprises an optical transceiver for infrared data communication with said processor.

14. The marine navigation light according to claim 12, wherein said monitoring software module comprises a series of computer-readable instructions for remote programming via said transceiver.

15. The marine navigation light according to claim 1, wherein said monitoring software module comprises a series of computer-readable instructions for switching off an LED light when its measured intensity falls below said minimum threshold.

16. The marine navigation light according to claim 15, wherein said monitoring software module comprises a series of computer-readable instructions for switching on a backup LED light.

17. A marine navigation light, comprising:

a base;

a lens mounted to the base;

an LED module seated in said base and enclosed by said lens, said LED module further comprising, a support member, an LED light mounted on the support member, a photodiode mounted on the support member and exposed to said LED light, and an electronic module comprising a processor and non-transitory computer-readable storage device storing a monitoring software module comprising a series of computer-readable instructions for monitoring an intensity of said LED light by the steps of, measuring light intensity input to said photodiode, comparing said measured intensity to a minimum threshold at said processor, signaling a failure when said measured intensity falls below said minimum threshold.

18. The marine navigation light according to claim 17, wherein said base is cylindrical with a screw-threaded mouth and said lens is externally-screw-threaded for insertion into said base.

19. The marine navigation light according to claim 18, wherein said lens is double-parabolic.

20. The marine navigation light according to claim 17, wherein said support member has a flat facing and corresponding shoulder, and wherein said at least one LED light is mounted on said flat facing, and wherein said at least one photodiode is mounted on said shoulder.

21. The marine navigation light according to claim 17, wherein said support member has a plurality of diametric flat facings and corresponding shoulders, a plurality of LED lights, and a plurality of photodiodes, wherein each said plurality of LED lights is mounted on one of said plurality of flat facing, and wherein each of said plurality of photodiodes is mounted on one of said plurality of shoulders.

22. The marine navigation light according to claim 17, wherein said LED module is substantially cylindrical except for said flat facing intersecting said shoulder.

23. The marine navigation light according to claim 17, wherein said LED module flat facing is perpendicular to said shoulder.

24. The marine navigation light according to claim 17, wherein said electronic module further comprises a transceiver for data communication with said processor.

25. The marine navigation light according to claim 24, wherein said electronic module further comprises an optical transceiver for infrared data communication with said processor.

26. The marine navigation light according to claim 25, wherein said monitoring software module comprises a series of computer-readable instructions for remote programming via said transceiver.

27. The marine navigation light according to claim 17, wherein said monitoring software module comprises a series of computer-readable instructions for switching off an LED light when its measured intensity falls below said minimum threshold.

28. The marine navigation light according to claim 27, wherein said monitoring software module comprises a series of computer-readable instructions for switching on a backup LED light.

29. The marine navigation light according to claim 17, wherein said monitoring software module comprises a series of computer-readable instructions for alternating use between two LED lights at startup.

* * * * *